US006173756B1

(12) United States Patent
Fehlemann

(10) Patent No.: US 6,173,756 B1
(45) Date of Patent: Jan. 16, 2001

(54) BROAD SIDE ELEMENT FOR A SLAB MOLD

(75) Inventor: Gereon Fehlemann, Düsseldorf (DE)

(73) Assignee: SMS Schloemann-Siemag AG, Düsseldorf (DE)

( * ) Notice: Under 35 U.S.C. 154(b), the term of this patent shall be extended for 0 days.

(21) Appl. No.: 09/346,829

(22) Filed: Jul. 2, 1999

(30) Foreign Application Priority Data

Jul. 2, 1998 (DE) ..... 198 29 606

(51) Int. Cl.[7] ..... B22D 11/055; B22D 11/057
(52) U.S. Cl. ..... 164/443; 164/418
(58) Field of Search ..... 164/443, 418, 164/459, 485

(56) References Cited

U.S. PATENT DOCUMENTS 3,866,664 * 2/1975 Auman et al. ..... 164/443
4,009,749 * 3/1977 Alberny ..... 164/443 X

FOREIGN PATENT DOCUMENTS 2212084 7/1989 (GB) .
561612 * 7/1977 (SU) ..... 164/418
573924 * 8/1986 (SU) ..... 164/418
WO95/21036 8/1995 (WO) .
WO95/26839 10/1995 (WO) .
WO97/43063 11/1997 (WO) .

* cited by examiner

*Primary Examiner*—J. Reed Batten, Jr.
(74) *Attorney, Agent, or Firm*—Brown & Wood, LLP

(57) ABSTRACT

A broad side element for slab mold and including a cast plate having opposite inner and outer surfaces and a plurality of grooves provided on the inner surface for forming cooling channels and having each an undercut, and a plurality of inserts receivable in the undercuts of respective cooling channel-forming grooves for formlockingly covering the respective grooves, with the broad side element having upper and lower regions, and with at least the upper region having a middle portion and two side portions located on opposite sides of the middle portion.

10 Claims, 2 Drawing Sheets

BROAD SIDE ELEMENT FOR A SLAB MOLD

BACKGROUND OF THE INVENTION

1. Field of the Invention

The present invention relates to a broad side element for a slab mold including a cast plate having opposite inner and outer surfaces, with the broad side element having upper and lower regions with at least the upper region having a middle portions and two side portion located on the opposite sides of the middle portion.

2. Description of the Prior Art

Such broad side elements for slab molds are generally known. They are particularly used in so-called compact strip production plants for slab thicknesses from 40 to 150 millimeters.

In the broad side elements of the prior art, a plurality of cooling grooves are formed in the cast plate in several operational steps. This formation of cooling grooves is associated with increased manufacturing costs. The cooling grooves are covered with a water box which is supported on the inner surface of the cast plate and is screwed thereto. The draw-back of this technology consists in that threaded inserts which are formed of steel are inserted into the cast plate which conventionally is formed of copper. When the cast plate is closed, a large quantity of copper is contaminated with steel which makes the reuse of the cast plate very difficult. In addition, the use of the threaded inserts in the copper plate is also associated with increased costs.

Accordingly, an object of the present invention is to provide a broad side element for a slab mold in which the cooling grooves can be formed with reduced costs and the contamination of the cast plate with steel is minimal which permits an easy reuse of the cast plate.

SUMMARY OF THE INVENTION

This and other objects of the present invention, which will become apparent hereinafter, are achieved by providing on the inner surface of the cast plate grooves with undercuts for forming cooling channels, with the grooves being formlockingly covered with inserts which are inserted in the undercuts.

In case when at least the middle portion of the upper region bulges with respect to the lower region, the inserts at least in the middle portion are divided into upper and lower insert sections.

When the inserts are provided on their sides opposite to the cooling channel-forming grooves with bridging shoulders, respectively, adjacent inserts adjoin each other, whereby a complete covering of the cast plate takes place.

When the inserts form a separate insert group, the broad side element can be more quickly mounted. In particular, the lower insert sections can form a separate lower insert section group. Likewise, the insert sections provided in the side portions of the upper region can form two side, insert section groups.

Because the heat removal need be effected only up to the grooves or the cooling channels and not further, the inserts can be made of steel, whereas the cast plate, preferably, is made of copper.

The inserts are preferably secured in the grooves with screws. To this end, they can be provided on their sides remote from the grooves with a thread in which a connection bolt is received.

The novel features of the present invention, which are considered characteristic for the invention, are set forth in particular in the appended claims. The invention itself, however, both as to its construction so to its mode of operation, together with additional advantages and objects thereof, will be best understood from the following detailed description of preferred embodiment when read with reference to the accompanying drawings.

DETAILED DESCRIPTION OF THE PREFERRED EMBODIMENT

Figure 1:
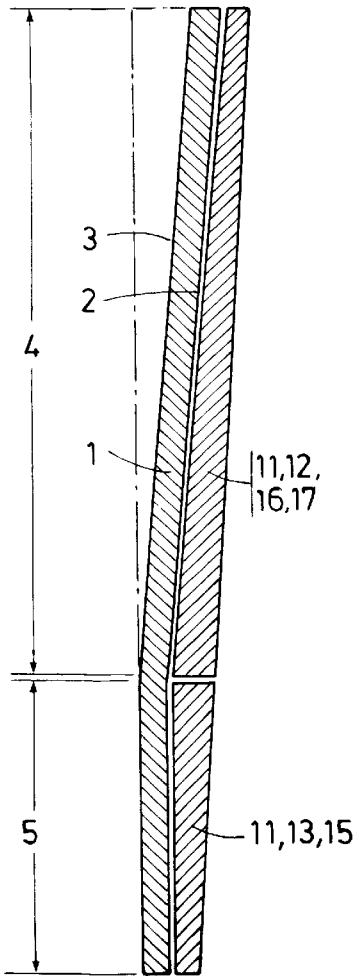
FIG. 1 a cross-sectional view over the broad side element for the slab mold according to the present invention.

A broad side element for a slab mold according to the present invention, which is shown in FIG. 1 has a cast plate 1. The cast plate 1 is formed of copper and has an opposite inner surface 2 and an outer surface 3. The cast plate is divided into an upper region 4 and a lower region 5, with the upper region 4 bulging, at least in its middle portion 6, with respect to the lower region 5.

Figure 2:
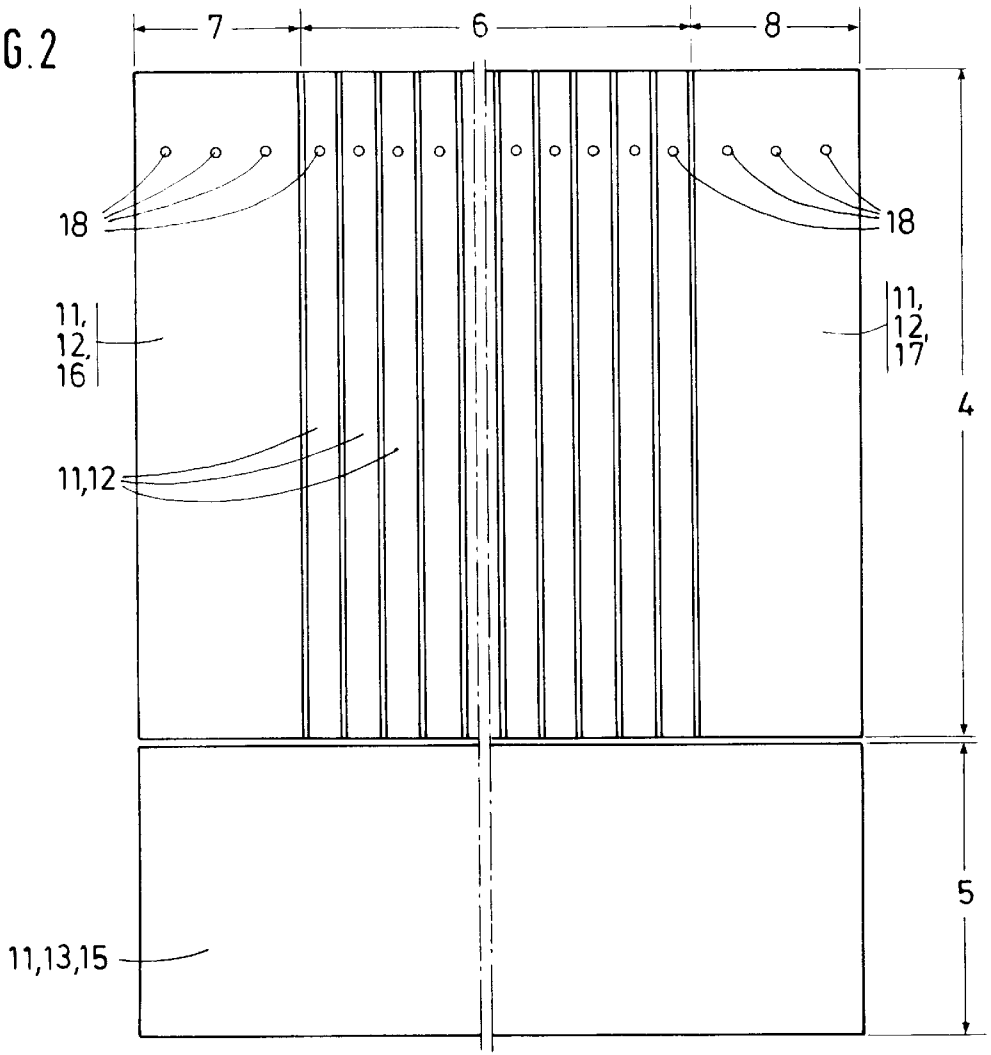
FIG. 2 a side view of the broad side element shown in FIG. 1 viewed in another direction.

The separation of the cast plate 1 into the upper region 4 and the lower region 5 is shown in FIG. 2. FIG. 2 further shows that the upper region 4 includes a middle portion 6 and two side portions 7 and 8 located on opposite sides of the middle portion 6.

Figure 3:
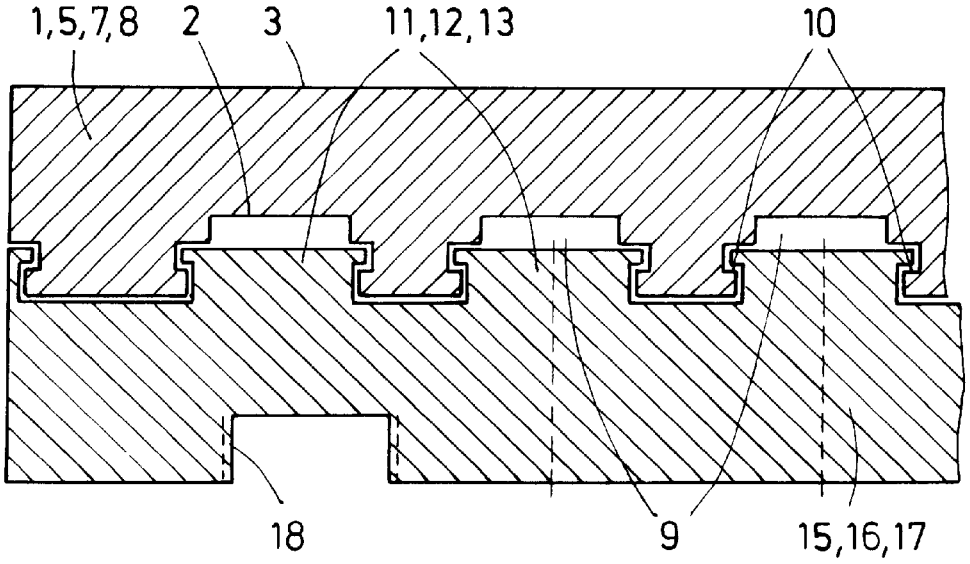
FIG. 3 a partial cross-sectional view of the broad side element viewed from above.
Figure 4:
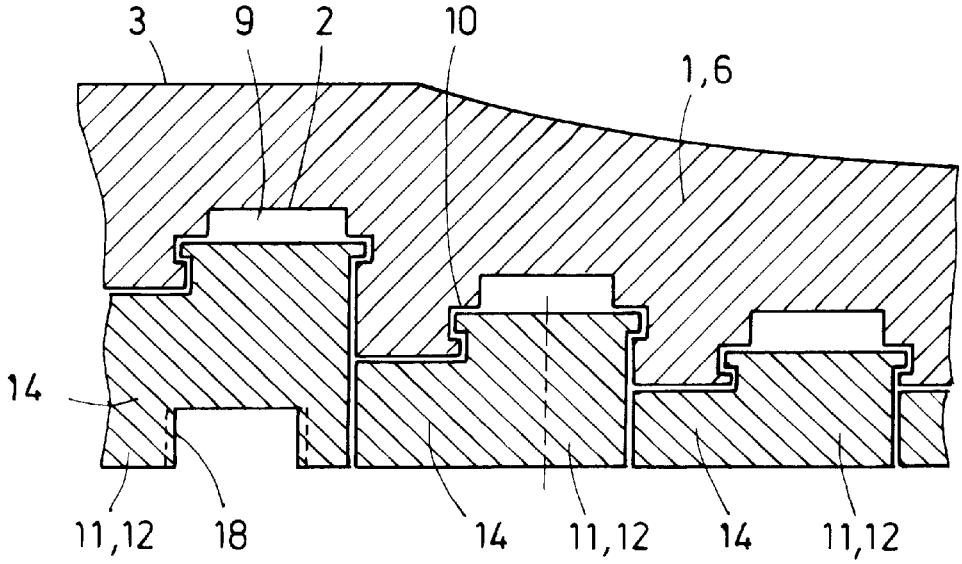
FIG. 4 a partial cross-sectional view of another portion of the broad side element shown in FIG. 1 viewed from above.

The inner surface 2 of the cast plate 1 has, as shown in FIGS. 3 and 4, grooves 9 with undercuts 10. Inserts 11 are inserted in the undercuts 10 of the grooves 9. The inserts 11 formlockingly cover the grooves 9. The inserts 11 are formed, preferably, of steel and are secured in the grooves 9 with screws 18. The screws are shown in FIGS. 3 and 4 with dashed lines.

No threads for the screws need be provided in the cast plate 1. Preferably, it is the inserts 11 which are provided with a thread. In this case, the screws secure the inserts 11 with the cast plate 1. Because of bulging between the upper region 4 and the lower region 5, the inserts 11 are divided in the upper region 4 into insert upper sections 12 and lower insert sections 13. This is clearly shown in FIG. 2.

The number of grooves formed in the inner surface 2 of the cast plate 1 depends on the weight of the cast plate 1 and amounts to generally from about 30 to about 50. Of these, approximately from 20 to 35 grooves are formed in the middle portion 6, and from 3 to 10 grooves are formed in the side portions 7 and 8.

FIGS. 3 and 4 show that the insert section 12 and 13 have on their sides opposite to the grooves 9 bridging shoulders 14. Thereby the adjacent insert sections 12 and 13 adjoin each other.

Generally, each groove 9 is associated with a separate insert 11 formed of two insert sections 12 and 13. For more rapid mounting of the broad side element, preferably, the insert sections 12 and 13 form groups of the insert sections. The insert section groups can be mounted selectively or be formed as one piece.

Preferably, the lower region 5 and the side portions 7 and 8 of the upper region are flat. Therefore, preferably, the lower insert sections 15 are formed as a separate lower insert section group 15. Likewise, the insert sections provided in the side portions 7 and 8 of the upper region 4 form two side insert section groups 16 and 17.

In the middle portion 6 of the upper region 4, the inclination of the adjacent grooves 9 changes from groove to groove. Therefore, as shown in FIG. 4, in the middle portion 6, a separate insert section 12 is used for each groove 9. Only in a particular case, here, can several insert sections 12 be formed in a separate upper insert section group.

In the embodiment shown in the drawings, only the middle portion 6 of the upper region 4 is bulging relative to the lower region 5. Therefore, alternatively only the inserts 11 in the side portions 7 and 8 of the upper region 4 can be formed into insert groups. In this case, the lower insert section group 15 extends only over the middle portion 6.

The cast plate 1, together with inserts 11, should be secured to a water box, not shown. This is effected, as a rule, with connection bolts not shown. In view of this, the inserts 11 are provided on their sides remote from the grooves 9 with a thread 18 for receiving a connecting bolt.

A broad side element according to the present invention provides a plurality of advantages. For example, no bolts need be provided on the back side of the cast plate. Further, no thread inserts need be provided in the cast plate. The grooves 9, the cooling channels, can be spaced from each other by the same distance.

Further, the grooves 9 are formed in the cast plate 11 with the reduced costs. Still further, the selection of the raw material for forming the cast plate 11 can be reduced. Further, the losses of the cast plates 1 can be reduced because they are free from the steel contamination and can be easily reused. Finally, the connection bolts do not noticeably affect the characteristics of the cast plate 1 because they are not connected with the cast plate 1 but rather with the inserts 11.

Though the present invention has been shown and described with reference to a preferred embodiment, such is merely illustrated of the present invention, and the present invention is not to be construed as to be limited to the disclosed embodiment and the details thereof, and the present invention includes all modifications, variations and/or alternating embodiment within the spirit scope of the present invention as defined by the appended claims.

What is claimed is:

1. A broad side element for slab mold, comprising a cast plate having opposite inner and outer surfaces and a plurality of grooves provided on the inner surface for forming cooling channels and having each an undercut; and a plurality of inserts receivable in the undercuts of respective cooling channel-forming grooves for formlockingly covering the respective grooves, Wherein the broad side element has upper and lower regions, with at least the upper region having a middle portion and two side portions located on opposite sides of the middle portion.

2. A broad side element as set forth in claim 1, wherein at least the middle portion of the upper region of the broad side element is bulged with respect to the lower region, and wherein the inserts are divided, at least in the middle portion of the upper region, in upper and lower insert sections.

3. A broad side element as set forth in claim 1, wherein the inserts are provided on sides thereof opposite to the cooling channel-forming grooves with bridging shoulders, respectively, whereby adjacent inserts adjoin each other.

4. A broad side element as set forth in claim 1, wherein the inserts form an insert group.

5. A broad side element as set forth in claim 2, wherein the lower insert sections form a separate lower insert section group.

6. A broad side element as set forth in claim 2, wherein the upper insert sections provided in the side portions of the upper region form two side, insert section groups.

7. A broad side element as set forth in claim 1, wherein the inserts are formed of a material different from the material the cast plate is formed of.

8. A broad side element as set forth in claim 7, wherein the inserts are formed of steel, and the cast plate is formed of copper.

9. A broad side element as set forth in claim 1, wherein the inserts are secured in the cooling channel-forming grooves with screws.

10. A broad side element as set forth in claim 1, wherein the inserts are provided, on sides thereof remote from the cooling channel-forming grooves, with a thread for receiving a connection bolt.

* * * * *